US008985226B2

(12) United States Patent
Head

(10) Patent No.: US 8,985,226 B2
(45) Date of Patent: Mar. 24, 2015

(54) ELECTRIC SUBMERSIBLE PUMP, TUBING AND METHOD FOR BOREHOLE PRODUCTION

(75) Inventor: Philip Head, Egham (GB)

(73) Assignee: AccessESP UK Limited, Surrey (GB)

( * ) Notice: Subject to any disclaimer, the term of this patent is extended or adjusted under 35 U.S.C. 154(b) by 858 days.

(21) Appl. No.: 13/147,340

(22) PCT Filed: Jan. 28, 2010

(86) PCT No.: PCT/GB2010/050133
§ 371 (c)(1),
(2), (4) Date: Aug. 1, 2011

(87) PCT Pub. No.: WO2010/086658
PCT Pub. Date: Aug. 5, 2010

(65) Prior Publication Data
US 2012/0024543 A1 Feb. 2, 2012

(30) Foreign Application Priority Data

Jan. 30, 2009 (GB) ..... 0901542.1
Nov. 23, 2009 (GB) ..... 0920431.4

(51) Int. Cl.
*E21B 23/00* (2006.01)
*E21B 27/00* (2006.01)
*E21B 33/03* (2006.01)
*E21B 17/10* (2006.01)
*E21B 43/12* (2006.01)

(52) U.S. Cl.
CPC ..... *E21B 17/10* (2013.01); *E21B 43/128* (2013.01)
USPC ..... 166/382; 166/107; 166/69

(58) Field of Classification Search
USPC ..... 166/382, 105, 206, 241.1, 241.4, 241.6, 166/77.51, 69, 107, 66.4, 162, 117
See application file for complete search history.

(56) References Cited

U.S. PATENT DOCUMENTS 2,137,997 A * 11/1938 Bendeler ..... 277/338
2,884,761 A 5/1959 Miles et al.
(Continued)

FOREIGN PATENT DOCUMENTS

EP 1706575 B1 12/2008
FR 2 659 748 A1 9/1991
(Continued)

OTHER PUBLICATIONS

GB Search Report, Application No. GB092043.4, Feb. 15, 2010.
(Continued)

*Primary Examiner* — Kenneth L Thompson
*Assistant Examiner* — Michael Wills, III
(74) *Attorney, Agent, or Firm* — Greenberg Traurig, LLP

(57) ABSTRACT

An electric submersible pump assembly (ESP) (21, 120) is deployed in a production tube (20, 100) in a borehole such that the motor (26, 41, 121) of the ESP is spaced from the inner wall of the production tube, defining a conduit (36, 111) through which the pumped well fluid can flow to cool the motor. The production tube may have an enlarged diameter portion (25, 76, 101) within which the motor is positioned. Alternatively or additionally, the ESP and/or the production tube may be provided with stabilizing spacers (24, 45, 140, 141) which extend between the ESP and the tube to centralize the ESP in the tube and support it against vibrational movement, the spacers defining an annular conduit (36, 111) between the motor casing and the production tube.

17 Claims, 9 Drawing Sheets

(56) References Cited

U.S. PATENT DOCUMENTS

| | | | | |
|---|---|---|---|---|
| 4,440,221 | A | 4/1984 | Taylor et al. | |
| 5,159,977 | A | 11/1992 | Zabaras | |
| 5,269,377 | A | 12/1993 | Martin | |
| 5,979,550 | A * | 11/1999 | Tessier | 166/212 |
| 6,457,531 | B1 * | 10/2002 | Bangash et al. | 166/369 |
| 6,595,295 | B1 * | 7/2003 | Berry et al. | 166/369 |
| 6,857,472 | B2 * | 2/2005 | Stave | 166/106 |
| 7,188,669 | B2 * | 3/2007 | Bullock et al. | 166/105 |
| 7,987,908 | B2 * | 8/2011 | Colley, III | 166/263 |
| 2003/0141056 | A1 | 7/2003 | Vandevier | |
| 2006/0272808 | A1 | 12/2006 | Doyle et al. | |
| 2008/0202748 | A1 | 8/2008 | Bussear et al. | |
| 2008/0245525 | A1 | 10/2008 | Rivas et al. | |
| 2008/0257561 | A1 * | 10/2008 | Fay et al. | 166/382 |
| 2009/0044954 | A1 * | 2/2009 | Caro et al. | 166/369 |
| 2009/0145612 | A1 * | 6/2009 | Olson et al. | 166/369 |
| 2013/0048287 | A1 * | 2/2013 | Simson et al. | 166/298 |
| 2013/0112431 | A1 * | 5/2013 | Morrow et al. | 166/380 |

FOREIGN PATENT DOCUMENTS

| | | | |
|---|---|---|---|
| GB | 2 326536 | A | 12/1998 |
| WO | WO 2007/079321 | A3 | 7/2007 |

OTHER PUBLICATIONS

GB Search Report, Application No. GB0920431.4, Aug. 18, 2010.
International Search Report, Jul. 2009.
Written Opinion, Jul. 2009.

* cited by examiner

ELECTRIC SUBMERSIBLE PUMP, TUBING AND METHOD FOR BOREHOLE PRODUCTION

CROSS REFERENCE TO RELATED APPLICATIONS

This application is a national stage entry of international application number PCT/GB2010/050133, having international filing date of Jan. 28, 2010, which was published in English, and which claims priority to Great Britain patent application no. GB 0901542.1, filed Jan. 30, 2009 and to Great Britain patent application no. GB 0920431.4, filed Nov. 23, 2009.

BACKGROUND OF THE INVENTION

1. Field of the Disclosure

This invention relates to systems for the production of well fluids, including for example oil and gas, from boreholes, and to production tubing and electric submersible pump assemblies for deployment in boreholes.

2. Description of the Related Art

An electric submersible pump assembly (hereafter referred to as an ESP) is deployed in oil wells and other boreholes to transport fluid to the surface, and comprises a pump, i.e. an impeller or other element that acts on the well fluid, coupled to an electric motor that drives it. (It will be understood by those skilled in the art that "a pump" and "an electric motor" include a stack of pumps or a stack of electric motors acting together so as to increase the power of the ESP.)

Production tubing may be either sectional, jointed tubing or continuous, coiled tubing, which is lowered down the borehole to provide a conduit through which the well fluid may be pumped to the surface. With the production tubing in place in the borehole, the ESP may then be lowered down the production tube on a flexible tether to a deployed position, typically proximate its lower end, and then sealed to the internal wall of the tubing by a packer so that the outlet of the pump is in fluid communication with the upper portion of the tube, which is used to conduct the well fluid to the surface. Conveniently, the flexible tether may incorporate an electric cable for supplying power to the motor. Alternatively, the tether may comprise a coiled tube, which may be used to conduct the well fluid to the surface, in which case the ESP may simply be suspended in the production tubing without a seal.

An arrangement of this general type is disclosed for example in US 2007/0289747 A1.

The motor of the ESP generates heat in service, and depending on the power of the pump, may require cooling to ensure the insulation and lubricants of the motor do not break down through excessive heat and damage the motor.

At low power, the static, ambient well fluid may be used to dissipate heat from the motor. However, as the power of the motor (or the temperature of the ambient fluid) increases, the static well fluid is no longer capable of cooling the motor and alternative methods have to be used. One known solution involves placing a shroud around the motor and passing fluid through this shroud. This cools the motor more than the ambient well fluid alone would, but at the expense of more components, greater cost and increased diameter of the pump assembly.

Alternatively, the motor may be cooled by allowing the well fluid passing through the pump to flow over the surface of the motor within the production tube.

In order to provide a conduit between the outer wall of the motor and the inner surface of the production tube, sufficient to carry the full flow of the well fluid passing through the pump so that the well fluid may cool the motor, the motor must necessarily be of substantially smaller diameter than the inner diameter of the production tube. This in turn disadvantageously limits the power of the motor and hence the output of the ESP.

Rather than reducing the diameter of the motor, the diameter of the production tube may be increased, which however substantially increases its cost. Moreover, the larger diameter of the production tube reduces the velocity of the well fluid, which in turn reduces its capacity to carry particulates from the well, leading to a buildup of sand and other debris which can clog the pump and the wellbore.

In practice, it is found in that, even where the motor is cooled by the well fluid passing over its surface within the production tube, overheating may still occur.

BRIEF SUMMARY

The object of the present invention is to provide an improved method and apparatus for pumping well fluid from a borehole, which in particular addresses the above mentioned problems.

According to the various aspects of the present invention, there are provided a system, a method, an electric submersible pump assembly and a production tube as defined in the claims.

BRIEF DESCRIPTION OF THE DRAWINGS

Various illustrative embodiments of the invention will now be described, purely by way of example and without limitation to the scope of the claims, and with reference to the following drawings, in which:

FIGS. 9-12 show a fifth electric submersible pump and a fifth production tube, wherein:

FIG. 10 is a longitudinal section through the tube and ESP in the deployed position;

FIG. 11 is a schematic plan view showing the tube and ESP in the deployed position;

Corresponding reference numerals indicate the same parts in each of the figures.

DETAILED DESCRIPTION

Figure 1:
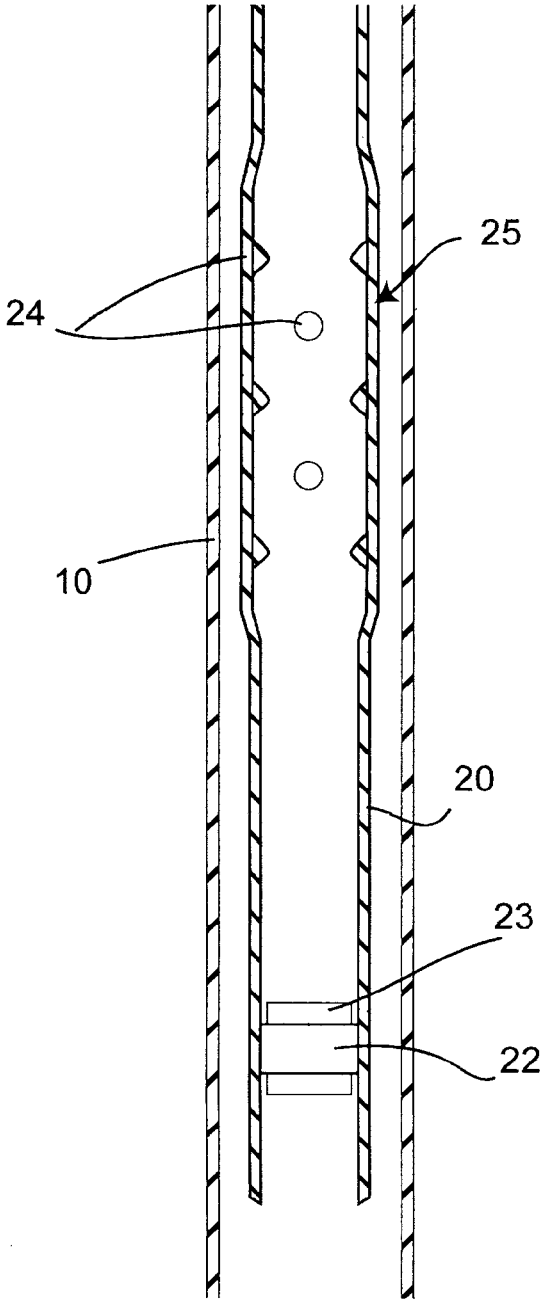
FIG. 1 shows a longitudinal sectional view of a first production tube deployed within a well casing.

Referring to FIG. 1, production tube 20 is installed in well casing 10. A seal 22 is located at the lower end of the production tube 20. The seal 22 has a landing seat 23 which incorporates a throughbore. The production tubing 20 has a region 25 of increased diameter, and a plurality of inwardly projecting protuberances 24 are spaced apart around its inner surface. The protuberances acts as stabilising elements or centralisers, and are formed as dimples which extend inwardly into the tube to substantially the same diameter as the internal diameter of its upper portion. Advantageously, the protuberances 24 formed as rounded dimples provide minimal resistance to fluid flowing through the conduit defined between the pump assembly and the tube, while their rounded contours avoid snagging the pump assembly during deployment.

Figure 2:
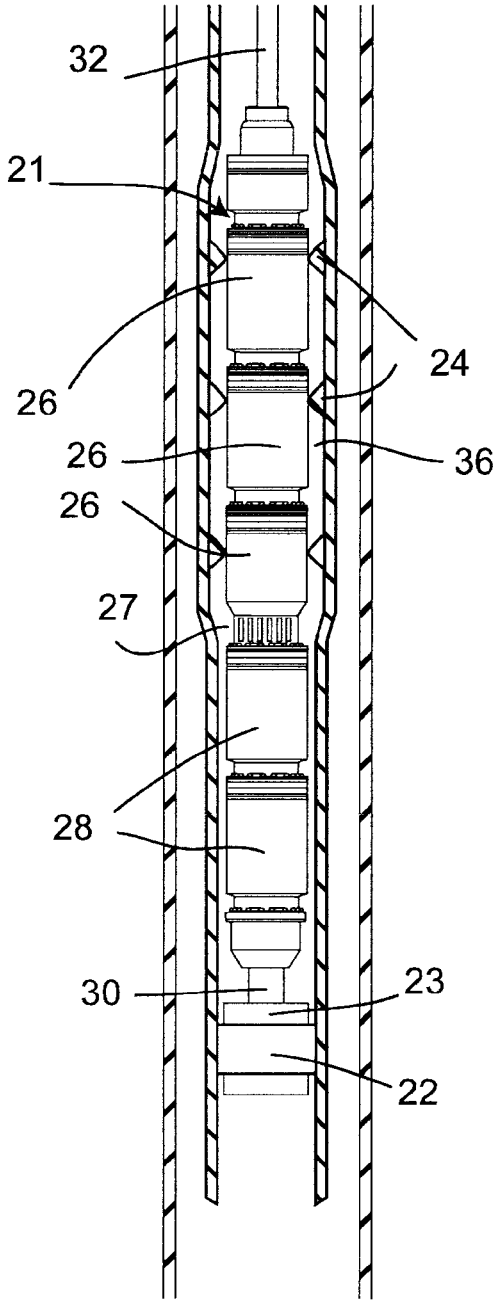
FIG. 2 shows a longitudinal sectional view of the first production tube and casing with a side view of a first electric submersible pump.
Figure 3:
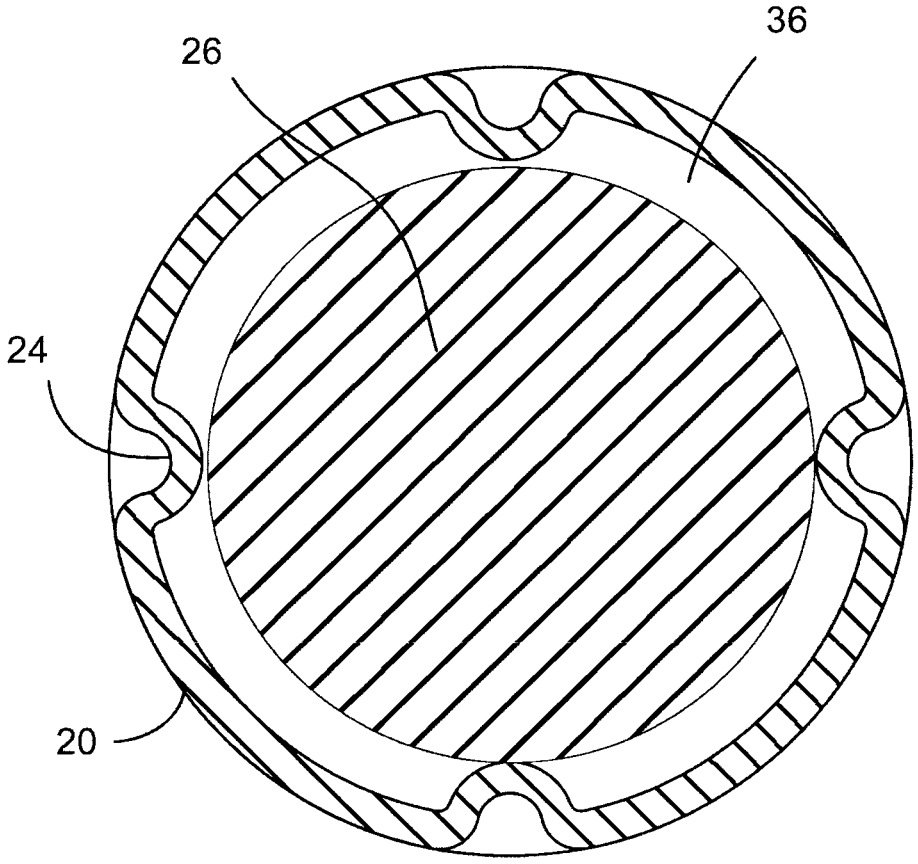
FIG. 3 shows a diagrammatic cross-sectional view of the first production tubing and electric submersible pump.

Referring to FIGS. 2 and 3, an ESP 21 is made up of a number of motor modules 26 connected together, arranged above a number of pump modules 28 arranged in series which are driven by the motor modules 26.

The ESP 21 is lowered on coiled tubing 32, which also carries a power supply cable. The lowermost pump terminates with an inlet tube 30. When the ESP 21 reaches the bottom of the production tube, the pump inlet tube 30 engages with the landing seat 23 of the seal 22. A pump outlet 27 is located between the pump modules 28 and the motor module 26.

In this position, the motor modules 26 of the ESP 21 are spaced from the inner surface of the production tube 20 by the centralisers 24, whose points describe a diameter slightly larger than the outer diameter of the electric submersible pump. In operation, the pump modules 28 urge fluid from beneath the seal 22, through the pump inlet 23, and the fluid passes out through the pump outlet 27, and flows through the annulus 36 between the inner surface of the production tube 20 and the outer surface of the motor modules 26.

The region 25 of increased diameter of the production tube allows for a greater rate of flow of fluid.

Moreover, the applicant has hypothesised that if the ESP is unsupported along its upper part, it may tilt in the production tube so that one side of the motors rest on the inner surface of the tube. It is believed that when this happens, the reduced fluid flow around the side of the motors resting on the production tube leads to non-uniform cooling of the motor casing. This in turn is believed to result in very slight deformation of the casing, which due to the very small clearance between the rotor and the stator, causes rubbing of the rotor, which explains the problem of overheating and damage to the motor which has been observed in prior art ESPs.

The applicant has found in practice that by arranging stabilising elements so as to centralise the motor in the production tube, the overheating problem previously observed is avoided, which is believed to be due to the uniform flow thus achieved around the circumference of the motors and the consequent uniform cooling of the motor casing, so that any thermal expansion is also uniform and does not result in deformation of the casing.

Modular motors stacked in series allow a long motor having a small outer diameter to be easily built up so that a large amount of power can be generated for a limited diameter; likewise, modular pumps in series allows the electric submersible pump to develop a large pressure differential between the pump inlet and pump outlet. However, the principles of the invention can equally be applied to ESPs having a single motor and single pump.

Figure 4:
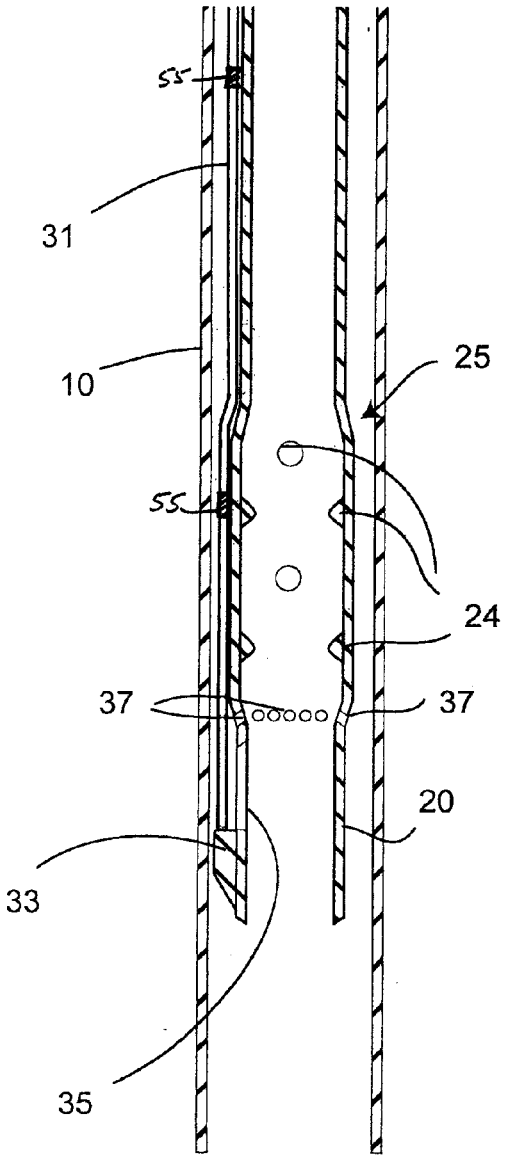
FIG. 4 shows a longitudinal sectional view of a second production tube deployed in a well casing.

Referring to FIG. 4, the ESP may be supplied with power by a cable 31 which is strapped to the outside of the production tube 20 by cable clamps 55 (visible only in FIG. 6) distributed along the length of the production tube 20 as required. The cable 31 terminates in an electrical connection block 33 which is located beneath an opening 35 in the production tube 20. As in the previous example, the production tube 20 has a region 25 of increased diameter, the inner surface of which features inwardly pointing centralisers 24. The region 25 also features inlet ports 37 around the production tube's circumference.

Figure 5:
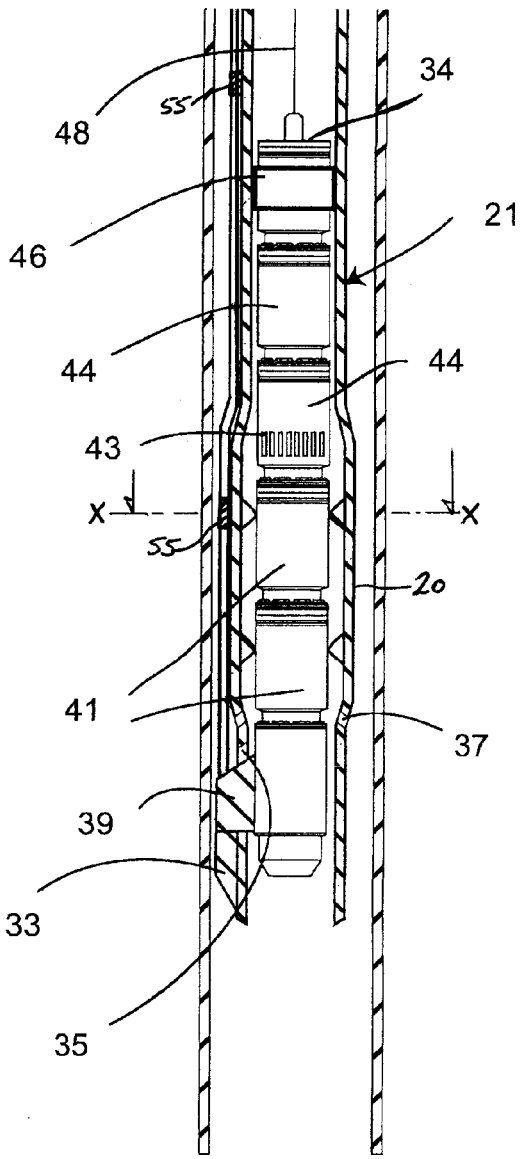
FIG. 5 shows a longitudinal sectional view of the second production tube and casing of FIG. 4 with a side view of a second electric submersible pump.
Figure 6:
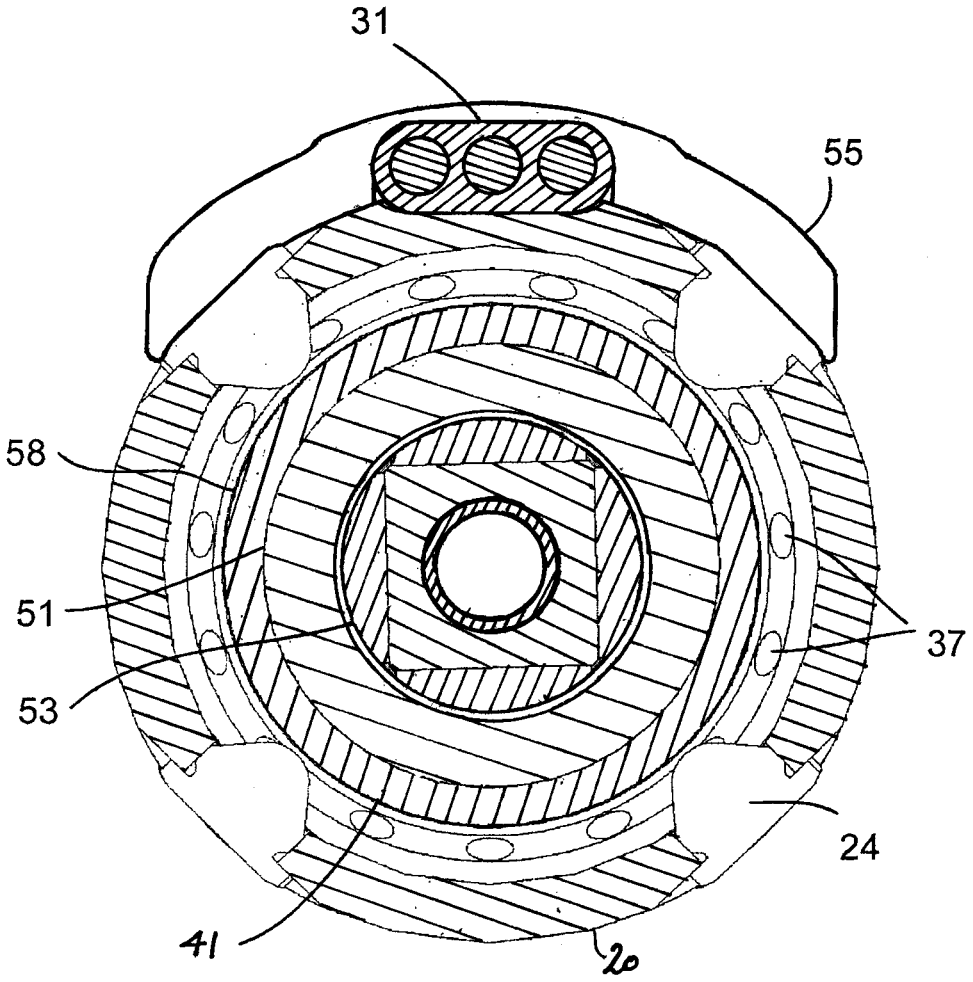
FIG. 6 shows a cross-sectional view of the production tubing and electric submersible pump of FIG. 5.

Referring to FIGS. 5 and 6, an electric submersible pump comprises a number of pump modules 44 located above a number of motor modules 41. As for the previous example, the pumps and the motors are connected in series, although it will be seen that in this embodiment, the pumps are situated above the motors. The lowermost pump includes a pump inlet 43, and a pump outlet 34 is situated above a engagable seal 46.

The electric submersible pump is lowered down the production tube 20 on a wireline 48 to the correct position. As the electric submersible pump nears its this position, a retractable electrical connector 39 extends from the electric submersible pump to project through the opening 35 and engage with the electrical connection block 33. The electric connector 39 and the electrical connection block 33 may mate using a known mechanism such as that described in UK patent GB2403490. As for the previous embodiment, the motor modules 41 are held in the centre of the increased diameter region 25 by the centralisers. As can be seen in FIG. 6, the centralisers may be formed from separate pieces that are fixed in or upon the wall of the production tube 20. In this cross sectional view, which shows a section through a motor module 44 (comprising a stator 51 and rotor 53), it can be seen how the centralisers 24 hold the motor module centrally so that there is a equal area around the entire circumference of the motor housing 58 for the pumped fluid to flow up through the inlets 37 and over the motor module to cool the motor module.

Once the electrical connector 39 has engaged with the connection block 33 and the electric submersible pump is supplied with power, the motor modules drive the pump modules 44 such that well fluid is drawn through the inlet ports 37 (and also around the bottom of the electric submersible pump, which is not sealed), over the outside of the motor modules 41, through the pump inlet 43 and pump modules 44 and then out through the pump outlet 34 and up through the production tube.

Figure 7:
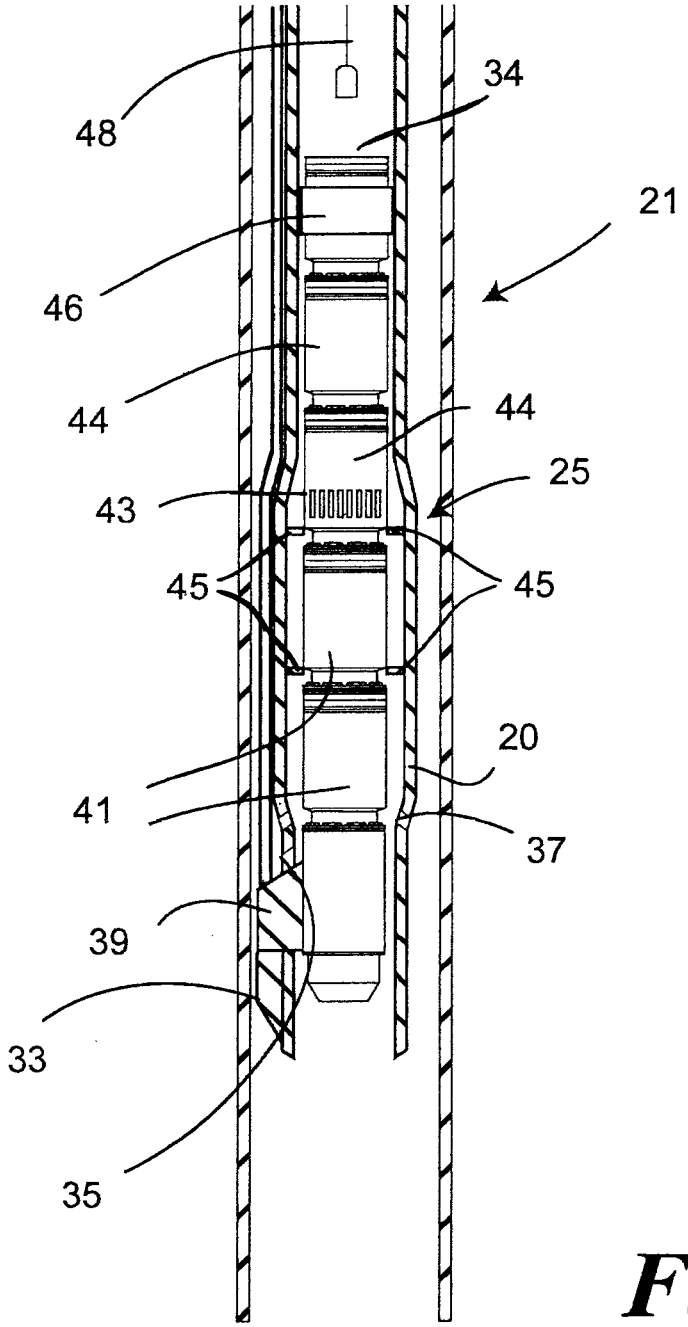
FIG. 7 shows a longitudinal sectional view of a third production tube with a side view of a third electric submersible pump.

Referring to FIG. 7, rather than the production tube 20 having centralisers formed from dimples, centralising means could be carried on the electric submersible pump itself. When the electric submersible pump is in position, centraliser blades 45 are activated to move from a retracted position inside the body of the electric submersible pump 21 around the motor modules 41 to an extended position where the blades 45 engage with the inner surface of the production tubing 20 in a region 25 of increased diameter. As for the centralisers located on the production tube 20 in the previous embodiments, the centraliser blades 45 secure the electric submersible pump 21, and the motor modules 41 in particular, in a central position in the production tube 20.

Since the power connection is supplied via a cable 31 attached to the production tube 20, the wireline 48 may be disconnected from the top of the electric submersible pump 21 and retrieved at the top of the borehole.

Figure 8:
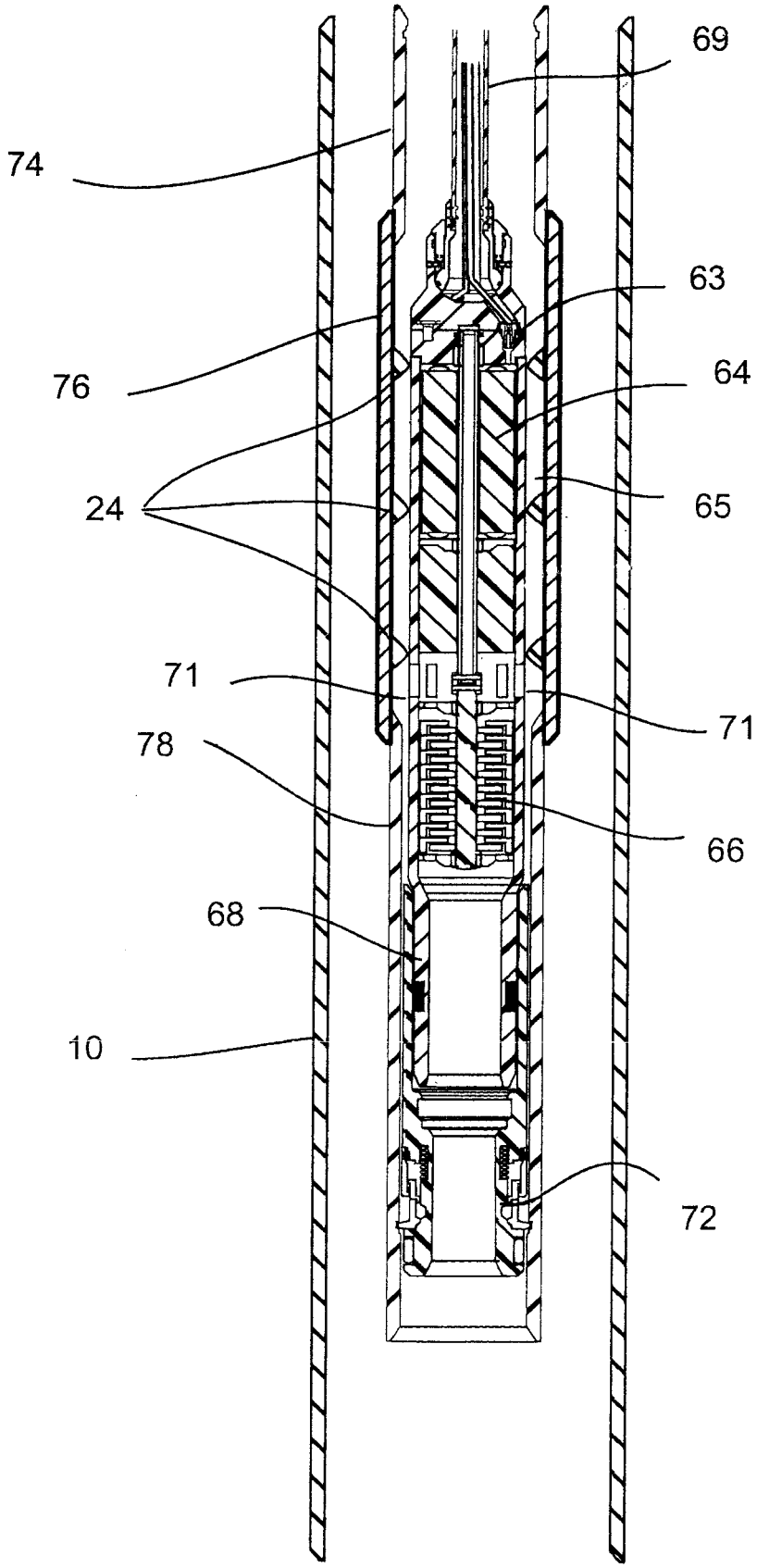
FIG. 8 shows a longitudinal sectional view of a fourth production tube and a fourth electric submersible pump.
Figure 9A:
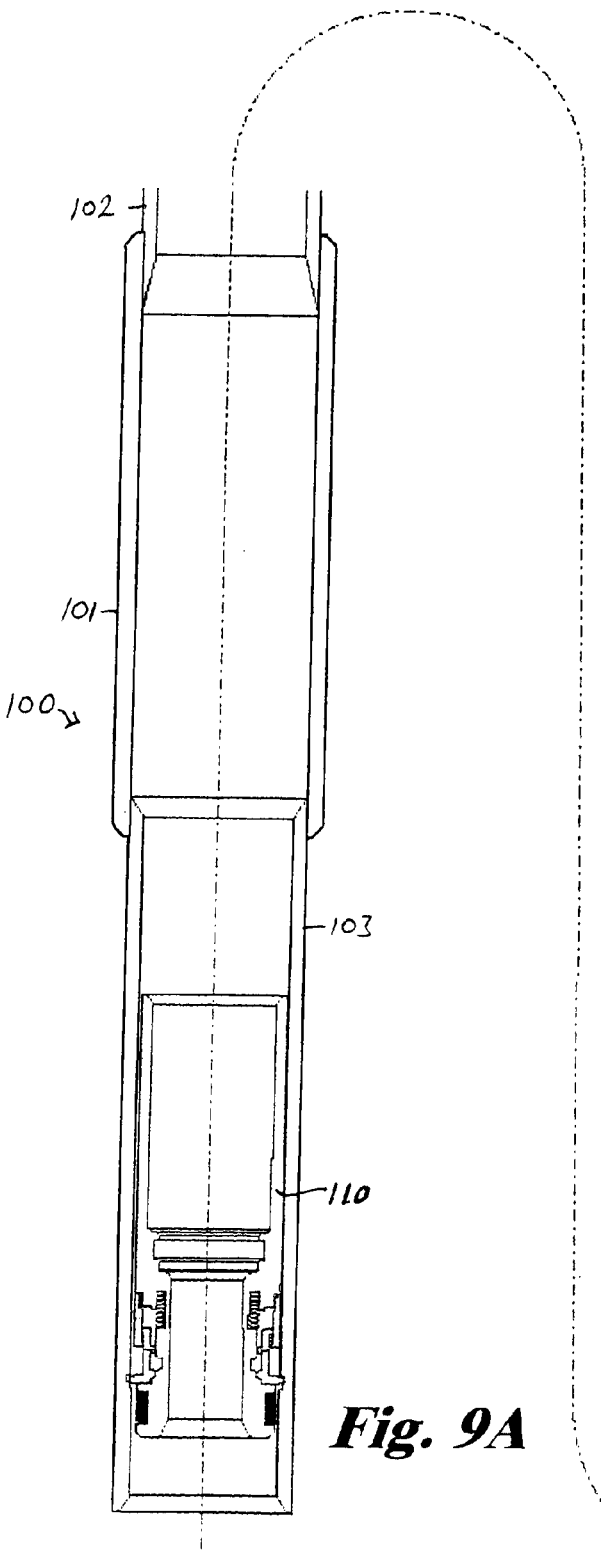
FIG. 9A is a longitudinal section through the production tube.
Figure 9B:
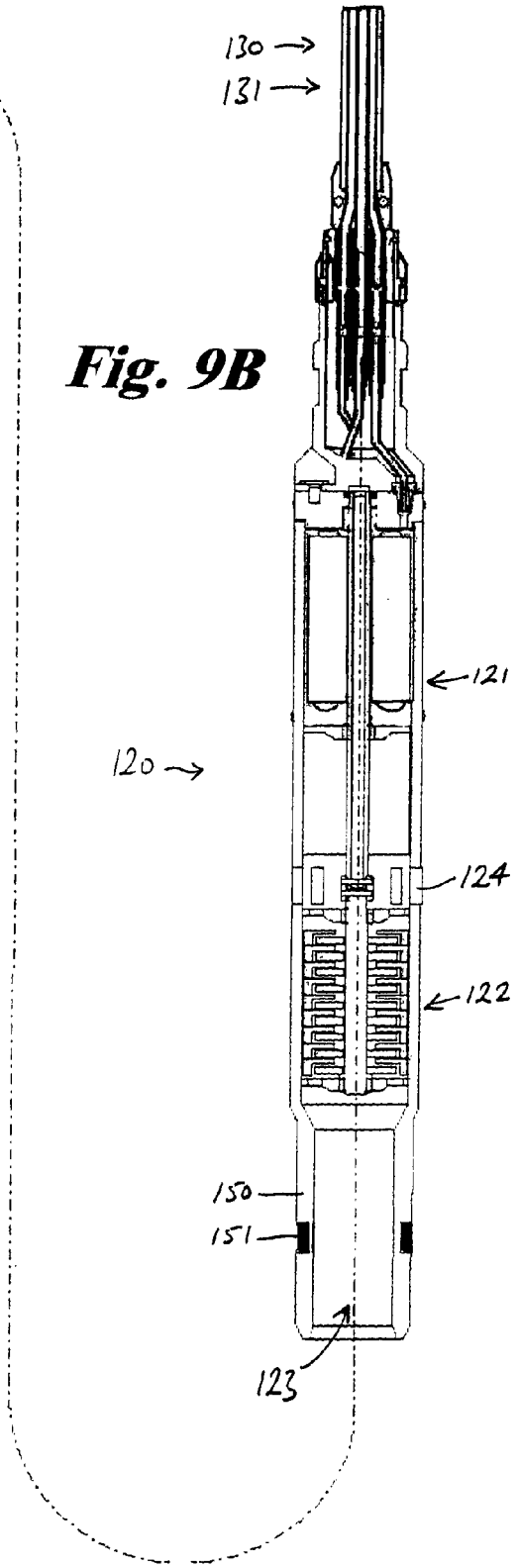
FIG. 9B is a longitudinal section through the ESP.
Figure 10:
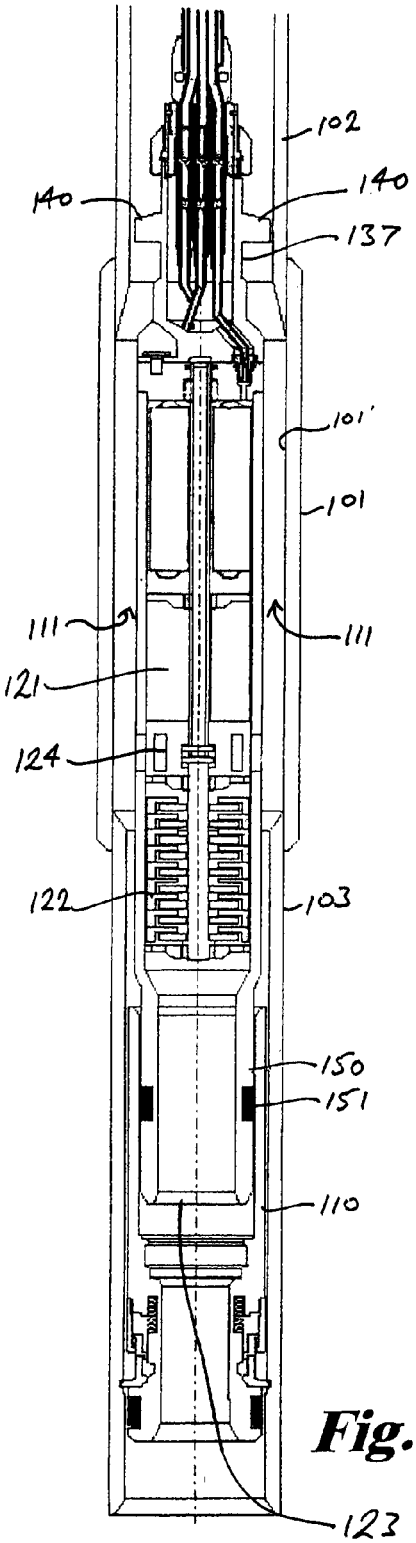
Figure 11:
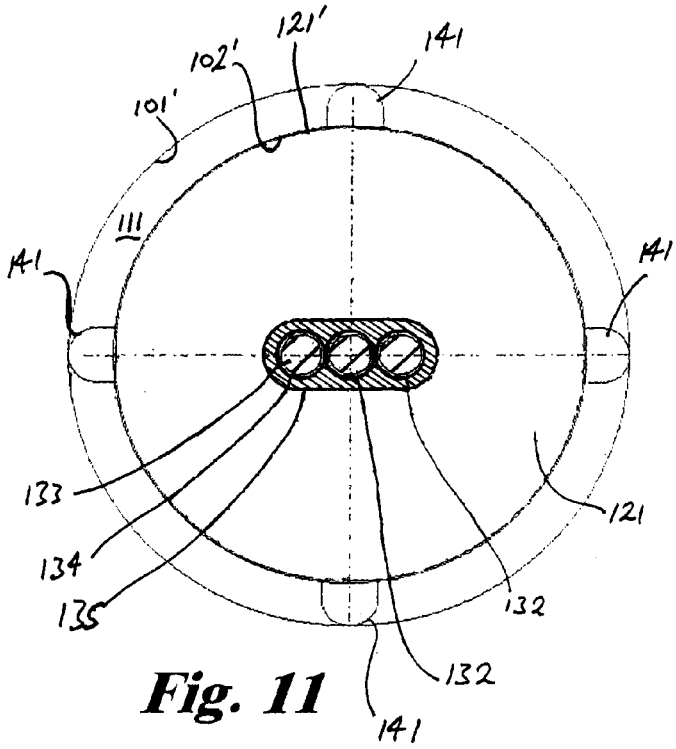
Figure 12A:
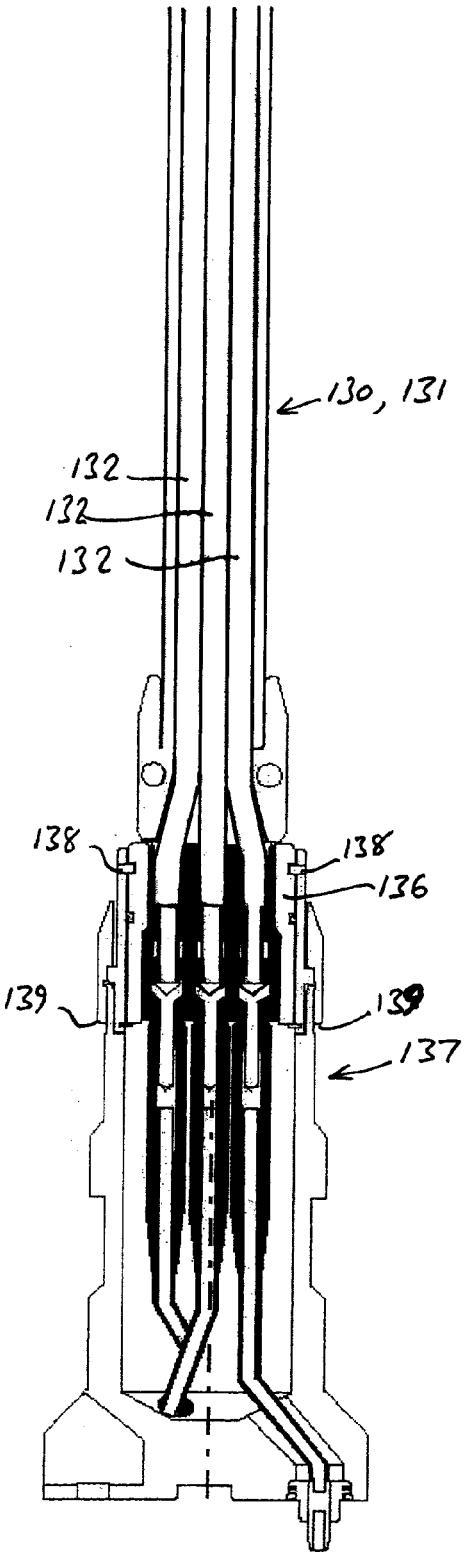
FIG. 12A is a longitudinal section through the upper end portion of the ESP.
Figure 12B:
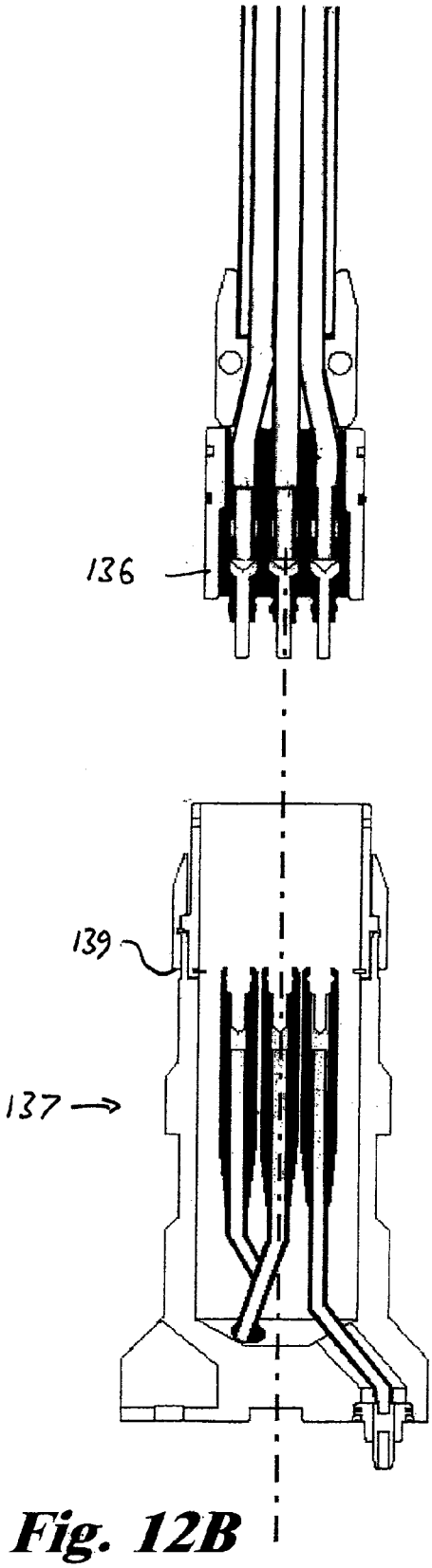
FIG. 12B corresponds to FIG. 12A showing the upper end portion of the ESP after separation of the tether at the shear connection.

It will be seen that the principles of spacing the motor from the side of the tube in which the electric pump is disposed can be easily adapted to different downhole systems. Referring to FIG. 8, an electric submersible pump comprises a brushless DC motor 64 which drives an impeller type pump 66. The electric submersible pump is lowered down on a power cable 69 so that the pump inlet 68 lands on a production tube shoe 72. In this embodiment, a region having a larger inner diameter is formed from a uniform piece of tubing 76, into which two other lengths of tubing 74, 78 (having outer diameters equal to the inner diameter of the tubing 76) have been inserted. Centralisers 24 formed or attached on the tubing 76 abut the motor housing 63 to ensure that the motor is spaced from the wall of the tube 76 and pumped well fluid can flow through the pump outlets 71 into the annulus 65 around the entire circumference of the motor 64 to cool it effectively. A valve could be included in the shoe 72 if desired. The centralisers may take any form, provided that a sufficient, preferably annular flowpath is left around the motor. The centralisers could for example be formed from vertical ribs instead of discrete, rounded dimples.

Referring to FIGS. 9-12, a fifth production tube 100 comprises an enlarged diameter portion 101, which may be a rigid tube that is jointed to the upper portion 102 above it and the lower portion 103 below it or alternatively may be formed by expanding a continuous coiled tube. A polished bore receptacle (PBR) 110 is sealingly engaged in the lower portion 103 of the tube, and includes a torque anchor which prevents it from rotating in the tube.

A fifth electric submersible pump assembly 120 comprises a motor 121 arranged above a pump 122 (i.e. it is a so-called "inverted ESP"), the pump having an inlet 123 and an outlet 124. The motor is supplied via an electric cable 130, which functions as a tether 131 for lowering the pump assembly down the production tube into the deployed position illustrated in FIG. 10. The cable comprises three conductors 132, each having a steel core 133 and a copper cladding 134 that carries most of the current, and an outer insulating jacket 135. The cable terminates in a block 136 which is attached to the upper end portion 137 of the ESP by means of a shear connection, comprising a plurality of dowels 138 which shear to release the block 136 from the upper end portion 137 when sufficient tensile stress is exerted on the tether. This ensures that the tether will detach before it breaks. If detachment occurs, for example, due to the ESP becoming jammed in the tube, then a retrieval tool can be lowered down the tube on a heavier wireline and engaged with an engagement profile 139 on the upper end portion 137, so that the wireline can then be used to haul the ESP to the surface.

In use, the ESP is introduced into the upper end of the production tube 100 and lowered on the tether down the upper portion 102 of the tube. The ESP is provided with a stinger 150 at its lower end which engages in the polished bore receptacle (PBR) 110 so as to locate the ESP in its deployed position with the motor positioned within the enlarged diameter portion of the tube. The stinger includes a seal 151, which seals the ESP to the production tube between the inlet and the outlet of the pump so that the outlet is in fluid communication with the upper portion 102 of the production tube. The stinger also includes a torque anchor which prevents the ESP from rotating relative to the PBR and hence relative to the tube. The ESP may then be operated to draw well fluid through the pump and expel it via the production tube 100 to the surface.

The upper end portion 137 may be provided with a plurality of fixed stabilising elements comprising fins 140 (shown in FIG. 10) which are spaced apart around the pump assembly and extend radially outwardly between the pump assembly and the tube, and which engage the inner surface of the upper portion 102 of the tube so as to space the motor from the enlarged diameter portion of the production tube to define a conduit 111 therebetween having a cross-sectional area sufficient for the passage of the well fluid passing through the pump. By positioning them on the upper end portion 137, which has a smaller diameter (i.e. a smaller maximum transverse dimension) than the internal diameter 102' of the upper portion 102 of the tube, the stabilising elements can be permanently fixed to the ESP without preventing it from being deployed down the tube from the surface, and serve to space the outer surface 121' of the casing of the motor 121 from the enlarged portion of the tube while allowing the well fluid to flow around the ESP and between the fins 140 as it travels up the tube to the surface. Advantageously, there is no point contact by any part of the tube against the casing of the motor 121, so localised damage due to vibration of the motor against the casing is avoided. In alternative embodiments, fixed stabilising elements may be positioned on the lower end or another reduced diameter portion of the ESP.

Alternatively or additionally, the ESP may be provided with a plurality of stabilising elements 141 (shown in FIG. 11) which are retractable and extendable (e.g. by hydraulic or electromagnetic or other suitable actuation means) from the ESP so that, once the ESP has reached the deployed position (FIGS. 10 and 11), they are extended radially outwardly beyond the outer diameter of the motor casing and beyond the inner diameter of the upper portion 102 of the production tube through which the pump assembly is deployed, so as to engage the inner surface 101' of the enlarged portion 101 of the tube as shown. The elements 141 are spaced around the outer circumference of the ESP proximate the motor and are retracted to allow the ESP to be withdrawn from the tube. Again, the retractable elements 141 space the motor from the production tube while ensuring that the casing of the motor does not make point contact against the tube, which avoids damage to the ESP due to vibration of the motor in service.

Both the fixed elements 140 and the retractable elements 141 allow the outer diameter of the motor to be only slightly less than the inner diameter of the upper portion of the production tube through which it is deployed, it being understood that the enlarged diameter portion of the production tube may conveniently be shorter than the length of the ESP. Thus, the major part of the production tube can be no wider than the ESP, so that the flow velocity is advantageously higher than it would be in a larger diameter tube, allowing effective clearance of debris to the surface, while the motor is effectively cooled by the well fluid pumped through the conduit 111. Moreover, the cooling flow is achieved without reducing the diameter and hence the power output of the motor. Since the enlarged diameter portion can be relatively short, the annulus between the production tubing and the well casing is also advantageously substantially unobstructed.

Preferably, the stabilising elements 140 and/or 141 are adapted to locate the motor substantially coaxially in the production tube as shown, so that the conduit 111 defines an annulus as shown between the motor and the tube. As previously mentioned, this is particularly advantageous in that it is found to overcome the problem observed in prior art systems of overheating of the motor in service, which is believed to be due to the fact that, in prior art arrangements, the end or ends of the ESP extending beyond the seal (or, where no seal is present, the whole of the ESP) may lie against the wall of the production tube, which can cause the casing of the motor to expand unevenly due to the reduced fluid flow and hence the reduced rate of cooling in the region where it touches the tube. Of course, the problem is substantially reduced by arranging the motor within the enlarged portion of the tube, even if no stabilising elements are used, so that the well fluid flows freely around the whole circumference of the motor casing.

In summary, an electric submersible pump assembly (ESP) is deployed in a production tube in a borehole such that the motor of the ESP is spaced from the inner wall of the production tube, defining a conduit through which the pumped well fluid can flow to cool the motor. The production tube may have an enlarged diameter portion within which the motor is positioned. Alternatively or additionally, the ESP and/or the production tube may be provided with stabilising spacers which extend between the ESP and the tube to preferably centralise the ESP in the tube and support it against vibrational movement, the spacers preferably defining an annular conduit between the motor casing and the production tube.

Rather than using a PBR, the stinger might alternatively be arranged to engage directly in the lower portion 103 of the production tube. Alternatively, the ESP might be provided with a packer which expands to engage the upper portion 102 or the enlarged diameter portion 101 of the tube. In alternative embodiments, the lower portion 103 of the production tube might be a larger or smaller diameter than the upper portion 102, and might be engaged by a stinger or a packer on the ESP; alternatively, the tube might not be provided with a lower portion 103.

The production tube can be any tube that a pump may be deployed in after lowering the tube into a borehole. The tether could comprise a continuous coiled tube, which may be hollow or may be filled with the insulated electric cable. Where the pumped fluid is conducted to the surface in the same tube that the electric submersible pump is deployed in, there must be a seal between the pump inlet and pump outlet; no seal is necessary however when a separate outlet tube, e.g. hollow coiled tubing functioning as the tether, is used to transport the fluid to the surface.

The centralisers could also be disposed down the borehole as a separate device to engage with production tubing, and engaged with the electric submersible pump when the pump reaches its deployed position.

The enlarged section could also be achieved by mechanically expanding the tubing in the well by deployed an expanding tool down the tubing either on wireline or coiled tubing to create the required larger diameter where the motors will be positioned.

In alternative, less preferred embodiments, stabilising elements or protuberances may be provided between the ESP and production tube in a production tube of constant diameter; alternatively, the production tube may be provided with an enlarged diameter portion, and the ESP may be deployed with the motor arranged in the large diameter portion, without the use of protuberances or stabilising elements.

The invention claimed is:

1. A pumping system for pumping well fluid from a borehole, the system comprising a production tube and an electric submersible pump assembly, the electric submersible pump assembly including a motor and a pump, the pump having an inlet and an outlet, and a tether for lowering the electric submersible pump assembly down the production tube into a deployed position, wherein the tube has an upper portion proximate an upper end thereof and an enlarged diameter portion below the upper portion, and the motor is located within the enlarged diameter portion in the deployed position, wherein the system includes a plurality of stabilising elements spaced apart around the electric submersible pump assembly and extending between the electric submersible pump assembly and the tube, the stabilising elements being arranged to space the motor from the production tube to define a conduit therebetween sufficient for the passage of the well fluid passing through the pump.

2. A system according to claim 1 wherein the stabilising elements are located on the tube.

3. A system according to claim 1 wherein the stabilising elements are located on the electrical submersible pump assembly.

4. A system according to claim 1 wherein the stabilising elements are arranged to position the motor substantially coaxially in the production tube so as to define an annulus between the motor and the tube.

5. A system according to claim 1, wherein a seal is provided for sealing the electric submersible pump assembly to the production tube between the inlet and the outlet so that the outlet is in fluid communication with an upper portion of the production tube in the deployed position.

6. A system according to claim 1 including a power cable attached to the production tube.

7. A system according to claim 1 wherein inlet ports are included in the production tube.

8. A pumping system for pumping well fluid from a borehole, the system comprising a production tube and an electric submersible pump assembly, the electric submersible pump assembly including a motor and a pump, the pump having an inlet and an outlet, and a tether for lowering the electric submersible pump assembly down the production tube into a deployed position, wherein the production tube has an upper portion proximate an upper end thereof, the upper portion defining a first inner wall, and an enlarged diameter portion defining a second inner wall below the upper portion, the second inner wall having a greater diameter than the first inner wall;

and the motor is located within the enlarged diameter portion in the deployed position, such that in the deployed position the motor is spaced apart from the second inner wall by a gap through which fluid can flow entirely around the motor.

9. An electric submersible pump assembly for deployment within a production tube in a borehole for pumping well fluid therefrom, the electric submersible pump assembly including a motor and a pump, the pump having an inlet and an outlet, and a tether for lowering the electric submersible pump assembly down the production tube to a deployed position, wherein the tube has an upper portion proximate an upper end thereof and an enlarged diameter portion below the upper portion, and the motor is located within the enlarged diameter portion in the deployed position, wherein the electric submersible pump assembly includes a plurality of stabilising elements spaced apart around the electric submersible pump assembly and extending radially outwardly to engage the production tube, the stabilising elements being arranged to space the motor from the production tube so as to define a conduit therebetween sufficient for the passage of the well fluid passing through the pump.

10. An electric submersible pump assembly according to claim 9, wherein the stabilising elements are fixed to the electric submersible pump assembly and extend outwardly to substantially the same diameter as the motor.

11. An electric submersible pump assembly according to claim 9, wherein the stabilising elements are retractable and extendable from the electric submersible pump assembly.

12. An electric submersible pump assembly according to claim 9, wherein the electric submersible pump assembly includes a seal for sealing the electric submersible pump assembly to the production tube between the inlet and the outlet so that the outlet is in fluid communication with an upper portion of the production tube in the deployed position.

13. An electric submersible pump assembly according to claim 9, wherein the stabilising elements are arranged to locate the motor substantially coaxially in the production tube so as to define an annular conduit therebetween.

14. A method for preventing overheating in an electric submersible pump producing well fluid from a borehole, comprising the steps of:

arranging a production tube in the borehole, the production tube having an upper portion proximate an upper end thereof, the upper portion defining a first inner wall, and an enlarged diameter portion defining a second inner wall below the upper portion, the second inner wall having a greater diameter than the first inner wall;

introducing an electric submersible pump assembly into the upper end of the tube, the electric submersible pump assembly having a motor and a pump, the pump having an inlet and an outlet; and lowering the electric submersible pump assembly down the upper portion of the tube to a deployed position in which the motor is positioned within the enlarged diameter portion of the tube, so as to define a conduit between the motor and the second inner wall of the tube sufficient for the passage of the well fluid passing through the pump, wherein the conduit extends entirely around the motor.

15. A method according to claim 14, wherein the electric submersible pump assembly is stabilised in the tube by means of a plurality of stabilising elements arranged around the electric submersible pump assembly so as to space the motor from the second inner wall of the tube.

16. A method according to claim 15, wherein the stabilising elements are extended radially outwardly from the electric submersible pump assembly in the deployed position to engage the enlarged diameter portion of the production tube.

17. A method according to 14, wherein the electric submersible pump assembly is sealed to the production tube between the inlet and the outlet so that the outlet is in fluid communication with the upper portion of the production tube.

* * * * *